US009376181B1

(12) United States Patent
Chiang et al.

(10) Patent No.: US 9,376,181 B1
(45) Date of Patent: Jun. 28, 2016

(54) WATER CRAFT ABLE TO OFFER FAST RESCUE

(71) Applicant: Ship and Ocean Industries R&D Center, New Taipei (TW)

(72) Inventors: Tsai-Min Chiang, New Taipei (TW); Chien-Hung Liu, New Taipei (TW); Fan-Bin Tseng, New Taipei (TW); Jung Liao, New Taipei (TW)

(73) Assignee: SHIP AND OCEAN INDUSTRIES R&D CENTER, New Taipei (TW)

( * ) Notice: Subject to any disclaimer, the term of this patent is extended or adjusted under 35 U.S.C. 154(b) by 0 days.

(21) Appl. No.: 14/581,629

(22) Filed: Dec. 23, 2014

(51) Int. Cl.

| | |
|---|---|
| ***B63H 11/00*** | (2006.01) |
| ***B63C 9/18*** | (2006.01) |
| ***B63B 1/24*** | (2006.01) |
| ***B63C 9/04*** | (2006.01) |
| ***B63C 9/02*** | (2006.01) |
| ***B63C 9/23*** | (2006.01) |
| ***B63B 1/26*** | (2006.01) |
| *B63B 35/00* | (2006.01) |

(52) U.S. Cl.
CPC . *B63C 9/04* (2013.01); *B63B 1/242* (2013.01); *B63B 1/246* (2013.01); *B63B 1/26* (2013.01); *B63C 9/02* (2013.01); *B63C 9/23* (2013.01); *B63H 11/00* (2013.01); *B63B 2035/005* (2013.01); *B63C 2009/042* (2013.01)

(58) Field of Classification Search
CPC .. B63B 2035/005; B63B 35/731; B63C 9/28; B63C 9/04; B63C 9/02; B63C 9/23; B63C 9/22; B63C 2009/042
USPC ..... 441/83, 40–42; 440/38–47
See application file for complete search history.

(56) References Cited

U.S. PATENT DOCUMENTS

| | | | | |
|---|---|---|---|---|
| 3,952,350 | A * | 4/1976 | Moucka | B63C 9/22 114/68 |
| 4,953,492 | A * | 9/1990 | Duffty | B60F 3/0007 114/282 |
| D334,731 | S * | 4/1993 | McCarty | D12/317 |
| 5,800,225 | A * | 9/1998 | Shoaff, III | B63C 9/02 114/39.14 |

* cited by examiner

*Primary Examiner* — Andrew Polay
(74) *Attorney, Agent, or Firm* — Ming Chow; Sinorica, LLC

(57) ABSTRACT

A water craft able to offer fast rescue includes a water craft provided with a pressurization pump and a high pressure air reservoir to have air pressurized and poured into the high pressure air reservoir and stored therein. The water craft is formed with a concealed storage space having an uninflated rescue device received therein. The rescue device communicates with the high pressure air reservoir so that the rescue device can be inflated via the high pressure air reservoir. Thus, before inflated, the rescue device can be entirely received in the concealed storage space, letting the water craft have good maneuverability and, after inflated, the rescue device will be ejected out of the concealed storage space for carrying many persons thereon, thus advantageous to carry out rescue mission.

1 Claim, 2 Drawing Sheets

WATER CRAFT ABLE TO OFFER FAST RESCUE

BACKGROUND OF THE INVENTION

1. Field of the Invention

This invention relates to a water craft, particularly to one able to offer fast rescue.

2. Description of the Prior Art

Recently, water leisure and recreation activities have been flourishing and consequently, various types of water crafts matching their characteristics and functions have developed different types for different uses. But along with increase of water leisure and recreation activities, opportunities of water rescue needed also increase greatly. To take a sweeping look, the water rescue crafts commonly seen on the market are mainly inflatable rubber boats. Although inflatable rubber boats can carry many persons for executing rescue mission, yet inflatable rubber boats are slow in speed and poor in wave resistance and hence incompetent to carry out emergent and fast rescue mission and thus may miss the opportunity of "golden window" for survivors. On the other hand, although water scooters are good in maneuverability, easy in operation, small in size and able to move quickly on water surface, yet water scooters are unable to carry many persons and incompetent to carry out rescue mission. In view of the situations mentioned above, the inventor of this invention has been devoted to doing research for improving water rescue crafts and hence devises this invention.

SUMMARY OF THE INVENTION

The objective of this invention is to offer a water craft able to offer fast rescue, which has high maneuverability and is able to move quickly to seize the opportunity of "golden window" for survivors and also able to carry many persons, really attaining the objective of quickly executing water rescue mission.

The water craft able to offer fast rescue in the present invention includes a water craft provided with at least one driving member, a pressurization pump and a high pressure air reservoir. The pressurization pump is connected with the high pressure air reservoir so that air can be pressurized to get into the high pressure air reservoir and stored therein by the pressurization pump. The water craft is further formed with a concealed storage space received therein with an uninflated rescue device. The rescue device communicates with the high pressure air reservoir so that the rescue device can be inflated by high pressure gas stored in the high pressure air reservoir. The rescue device is further provided with a deflation member for deflating the rescue device and, after deflated, the rescue device is received in the concealed storage space.

Thus, when the rescue device is not yet inflated, the rescue device can be received in the concealed storage space to let the water craft has good maneuverability and able to move quickly for seizing the opportunity of "golden window" for survivors. When inflated, the rescue device can be quickly ejected out of the concealed storage space to form a rescue device for carrying many persons, thus attaining an objective of quickly carrying out water rescue mission.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
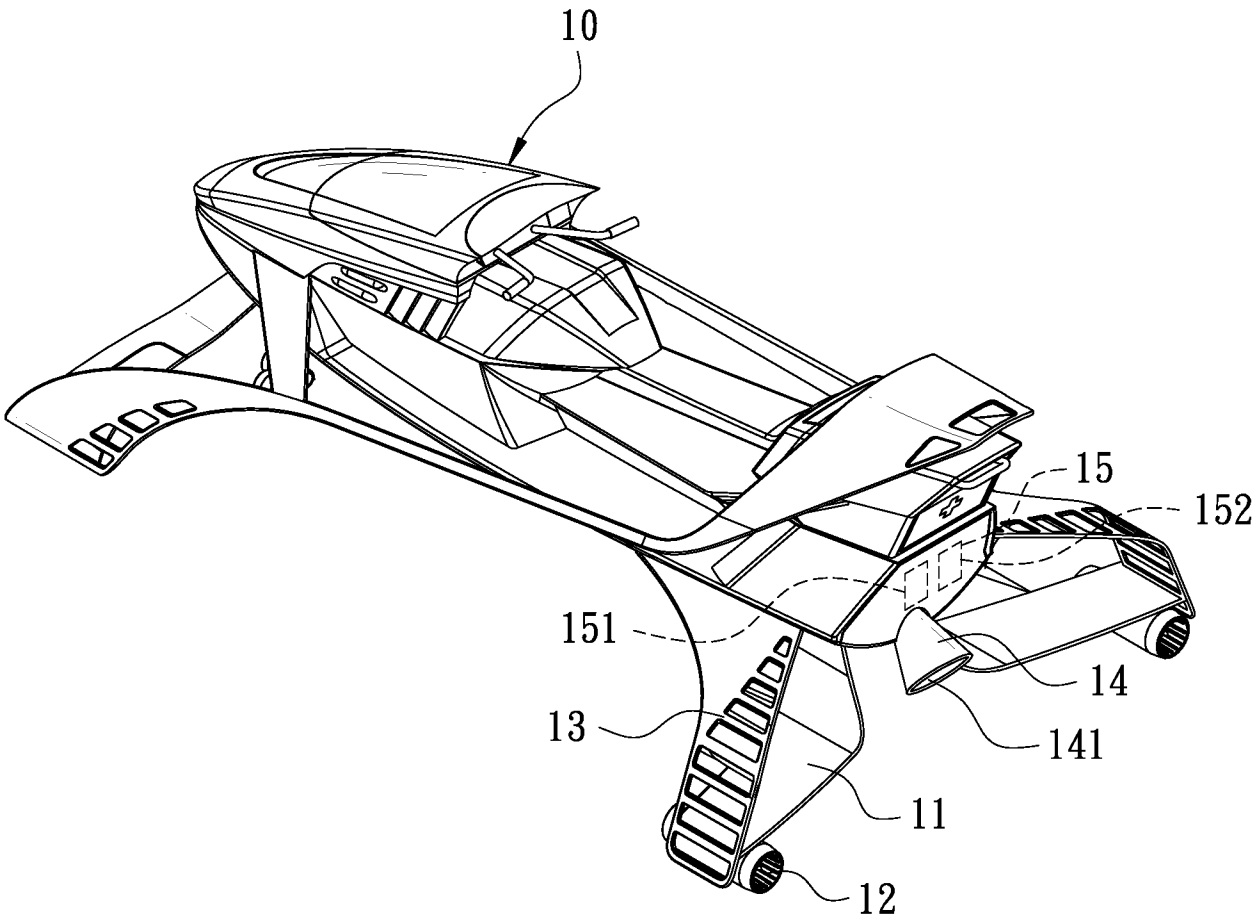
FIG. 1 is a perspective view of a pattern of a water craft able to offer fast rescue in the present invention.
Figure 2:
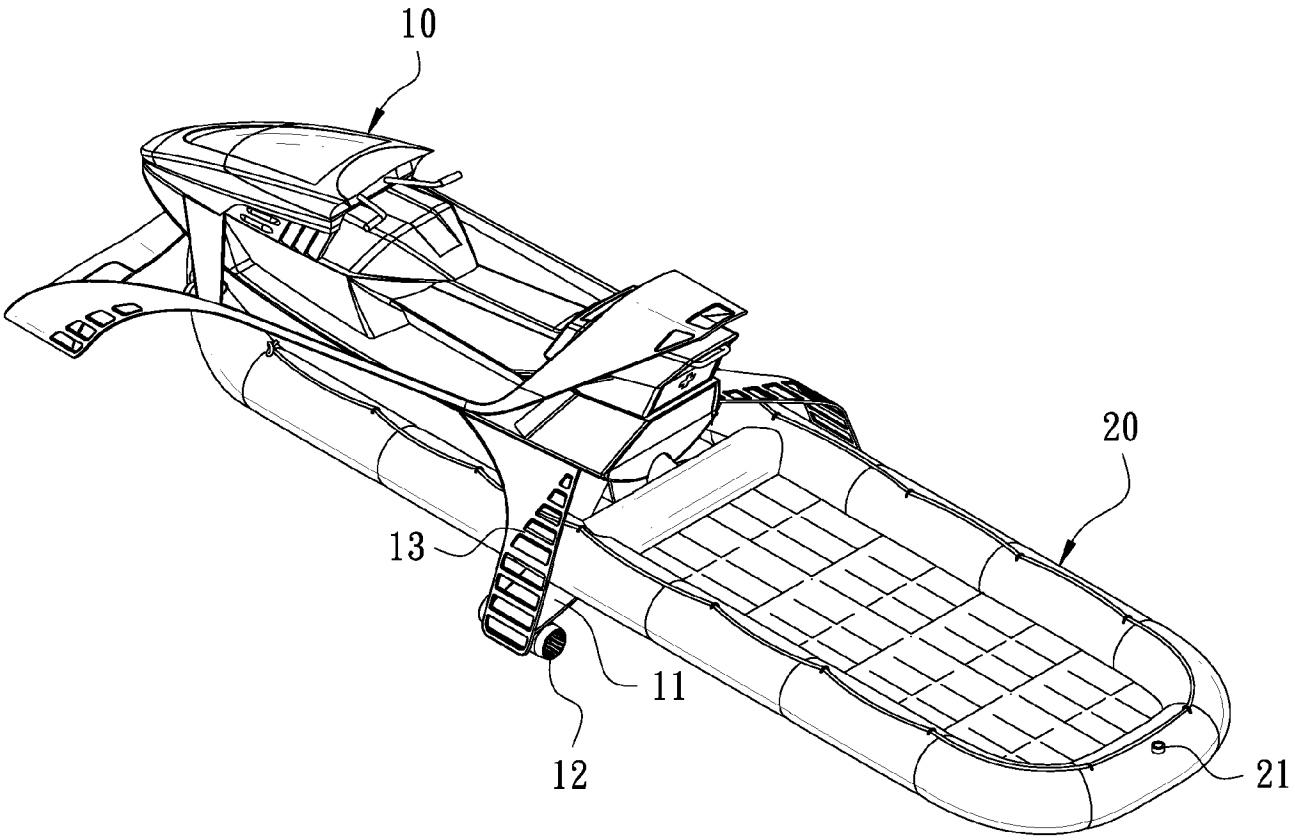
FIG. 2 is a perspective view of another pattern of the water craft that is provided with an inflatable rubber boat for carrying out fast rescue in the present invention.

A preferred embodiment of a water craft able to offer fast rescue in the present invention, as shown in FIGS. 1 and 2, includes a water craft 10 and a rescue device 20 as main components combined together.

The water craft 10 has a left side and a right side respectively provided with a hydrofoil 11 stretching far away from the water craft 10 for elevating moving speed in water of the water craft 10. In this invention, the hydrofoils 11 are stretched toward the underside and the outer side of the water craft 10 and have their ends respectively installed with a driving member 12, which is a jet engine, and further have their topsides respectively provided with a ladder frame 13 having one end fixed at a peripheral side of the water craft 10 and another end positioned at the end of the hydrofoil 11. In addition, the water craft 10 is formed with a concealed storage space 14 at a rear lower side and positioned below the water line of the water craft 10. The concealed storage space 14 has a rear side bored with an opening 141 by which the concealed storage space communicates with the outside. Moreover, the concealed storage space 14 of the water craft 10 is provided with at least one air inflation device 15 that consists of a pressurization Pump 151 and a high pressure air reservoir 152, with the pressurization Pump 151 connected with the high pressure air reservoir 152 so that air can be pressurized to get into the high pressure air reservoir 152 and stored therein by the pressurization pump 151.

The rescue device 20 is received in the concealed storage space 14 when the rescue device 20 is not yet inflated. The rescue device 20 communicates with the high pressure air reservoir 152 so that the rescue device 20 can be inflated with high pressure gas stored in the high pressure air reservoir 152. The rescue device 20 is further disposed with a deflation member 21 for the rescue device 20 to carry out deflation, and after being deflated, the rescue device 20 is received in the concealed storage space 14 anew, in this invention, the rescue device 20 being an inflatable rubber boat. Before inflated, the rescue device can be entirely stored in the concealed storage space 14, and when rescue device 20 is being inflated, the rescue device 20 will be quickly ejected out of the concealed storage space 14 through the opening 141 to make up the rescue device at the rear side of the water craft 10 for carrying many persons.

Referring to FIGS. 1 and 2, in normal times, the water craft able to offer fast rescue in the present invention has the rescue device 20 received in the concealed storage space 14, letting the water craft 10 form a fast rescue pattern and thus, the water craft able to offer fast rescue of this invention has the advantages of a water scooter: nimble and handy, easy in operation, small in size, able to move quickly on water surface and excellent in maneuverability. Therefore, the executors of water rescue can quickly get to the scene of rescue to seize the opportunity of "golden window" for survivors, and when the water craft able to offer fast rescue moves quickly, the two hydrofoils 11 will be helpful to enhance the moving velocity of the water craft 10, letting the water craft able to offer fast rescue has the advantages of being nimble and agile of a water scooter and the advantages of being quick, energy-saving and high efficiency of a hydrofoil craft. After the water craft able to offer fast rescue gets to the scene of rescue, the rescue device 20 can instantly and quickly be inflated within five seconds by high pressure gas stored in the high pressure air reservoir 152, letting the water craft able to offer fast rescue become a power rubber boat to form a rubber boat rescue pattern, able to carry many persons and advantageous to execute rescue mission. Further, the air inflation device 15 can be optionally provided with no high pressure air reservoir 152 and in this case, the rescue device 20 can be directly inflated by means of the pressurization pump 151.

A first special feature of this invention is that the water craft able to offer fast rescue has two opposite rear sides respectively disposed with the ladder frame 13 at the location of the hydrofoil 11 for facilitating personnel to get on and get off the rescue device 20 and the water craft 10.

A second special feature of this invention is that the water craft able to offer fast rescue uses jet engines as power sources of the driving members 12, thus able to prevent exposed oars of a conventional outboard engine from injuring people around and also advantageous to carry out rescue mission. Furthermore, the two driving members 12 are respectively mounted at the left side and the right side of the water craft 10 via the two hydrofoils 11 so as to keep away from the rescue device 20 at the rear side of the water craft 10 for avoiding the rescue device 20 being disturbed by water current and causing jolt, able to elevate stability and the degree of stability of the water craft able to offer fast rescue.

The water craft able to offer fast rescue of this invention has all the advantages of a nimble and handy water scooter, of a quick and energy-saving hydrofoil craft and of a fast inflatable rubber boat with space resilience. Therefore, the water craft able to offer fast rescue of this invention has become a new generation of fast rescue water crafts, not only having good mobility and able to move quickly for seizing the opportunity of "golden window" for survivors, but also able to make up a rescue device for carrying many persons if necessary, thus attaining an objective of quickly carrying out water rescue mission.

To sum up, this invention has the following advantages and efficacies:

1. The water craft able to offer fast rescue of this invention has good maneuverability and can move quickly for seizing the opportunity of "golden window" to carry out rescue mission when the rescue device is not yet inflated and received in the concealed storage space.

2. If necessary, in the process of executing rescue mission, the rescue device can be quickly inflated to let the rescue device rapidly ejected out of the concealed storage space to make up a rescue device for carrying many persons thereon, thus advantageous to carry out rescue work and able to attain an objective of quickly executing water rescue mission.

While the preferred embodiment of the invention has been described above, it will be recognized and understood that various modifications may be made therein and the appended claims are intended to cover all such modifications that may fall within the spirit and scope of the invention.

What is claimed is:

1. A water craft able to offer fast rescue comprising:

a water craft provided with at least one driving member, said water craft formed with a concealed storage space, said concealed storage space provided with at least one air inflation device, said air inflation device containing at least one pressurization pump; and a rescue device received in said concealed storage space, said rescue device connected with said air inflation device so that said rescue device can be inflated by said air inflation device, said rescue device ejected out of said concealed storage space when said rescue device is being inflated, said rescue device provided with a deflation member, said rescue device received in said concealed storage space anew after said rescue device is deflated;

said air inflation device contains a high pressure air reservoir, said pressurization pump connected with said high pressure air reservoir, air pressurized and poured into said high pressure air reservoir and stored therein by said pressurization pump;

said water craft has two sides respectively disposed with at least one hydrofoil for elevating moving speed in water of said water craft;

said driving members are symmetrically fixed at two sides of said water craft, and said driving member is a jet engine;

said water craft has peripheral sides provided with at least one ladder frame;

said concealed storage space is positioned below waterline of said water craft and formed with an opening at a rear side, said concealed storage space communicating with the outside via said opening, said rescue device ejected out of said concealed storage space through said opening when said rescue device is being inflated; and said rescue device is an inflatable rubber boat.

* * * * *